US011728072B2

(12) United States Patent
Sangar et al.

(10) Patent No.: US 11,728,072 B2
(45) Date of Patent: Aug. 15, 2023

(54) METHOD FOR CREATING A TRANSITION JOINT BETWEEN TWO CABLES USING CANTED COIL SPRINGS AND A CABLE ASSEMBLY HAVING SUCH A TRANSITION JOINT

(71) Applicant: NEXANS, Courbevoie (FR)

(72) Inventors: Robin Sangar, Drobak (NO); Per Arne Osborg, Asker (NO); Audun Johanson, Oslo (NO)

(73) Assignee: NEXANS, Courbevoie (FR)

( * ) Notice: Subject to any disclaimer, the term of this patent is extended or adjusted under 35 U.S.C. 154(b) by 22 days.

(21) Appl. No.: 17/239,159

(22) Filed: Apr. 23, 2021

(65) Prior Publication Data

US 2021/0350954 A1 Nov. 11, 2021

(30) Foreign Application Priority Data

Apr. 30, 2020 (EP) ..... 20305422

(51) Int. Cl.
*H01B 9/00* (2006.01)
*H01R 13/24* (2006.01)

(52) U.S. Cl.
CPC ..... *H01B 9/006* (2013.01); *H01R 13/2421* (2013.01)

(58) Field of Classification Search
CPC ..... H01B 9/006; H01R 13/2421
See application file for complete search history.

(56) References Cited

U.S. PATENT DOCUMENTS

| | | | | |
|---|---|---|---|---|
| 5,474,479 | A | 12/1995 | Bennett et al. | |
| 8,342,893 | B2 * | 1/2013 | Glick | H01R 13/187 439/840 |
| 9,054,445 | B2 * | 6/2015 | O'Sullivan | H01R 13/5216 |
| 9,490,577 | B2 * | 11/2016 | Diop | H01R 4/5083 |
| 10,634,181 | B2 * | 4/2020 | Montague, Jr. | H01R 4/4863 |
| 10,640,978 | B2 * | 5/2020 | Sorkin | E01F 15/06 |
| 10,655,665 | B2 * | 5/2020 | Balsells | F16B 21/18 |
| 10,935,097 | B2 * | 3/2021 | Kompa | F16F 1/426 |
| 10,965,055 | B2 * | 3/2021 | Kompa | H01R 13/6271 |
| 2009/0149053 | A1 * | 6/2009 | Chansrivong | H01R 13/533 439/349 |
| 2010/0199493 | A1 * | 8/2010 | Chansrivong | H01R 13/15 29/869 |
| 2010/0216356 | A1 | 8/2010 | Takehara | |
| 2013/0149029 | A1 * | 6/2013 | Changsrivong | A61N 1/3752 403/361 |
| 2014/0273575 | A1 | 9/2014 | O'Sullivan | |

OTHER PUBLICATIONS

European Search Report dated Dec. 16, 2020.

* cited by examiner

*Primary Examiner* — Harshad C Patel
(74) *Attorney, Agent, or Firm* — Sofer & Haroun, LLP

(57) ABSTRACT

A cable assembly (100) having a first cable (20) having a first conductor (22), a second cable (40) having a second conductor (42) and an electrically conducting joining element (60). The joining element (60) has a first opening (61) and a second opening (63). The cable assembly (100) comprises a number of canted coil springs (70). A terminal portion of the first conductor (22) is secured to the first opening (61) by means of a first canted coil spring (70). A terminal portion of the second conductor (42) is secured to the second opening (63) by means of a second canted coiled spring (70).

22 Claims, 6 Drawing Sheets

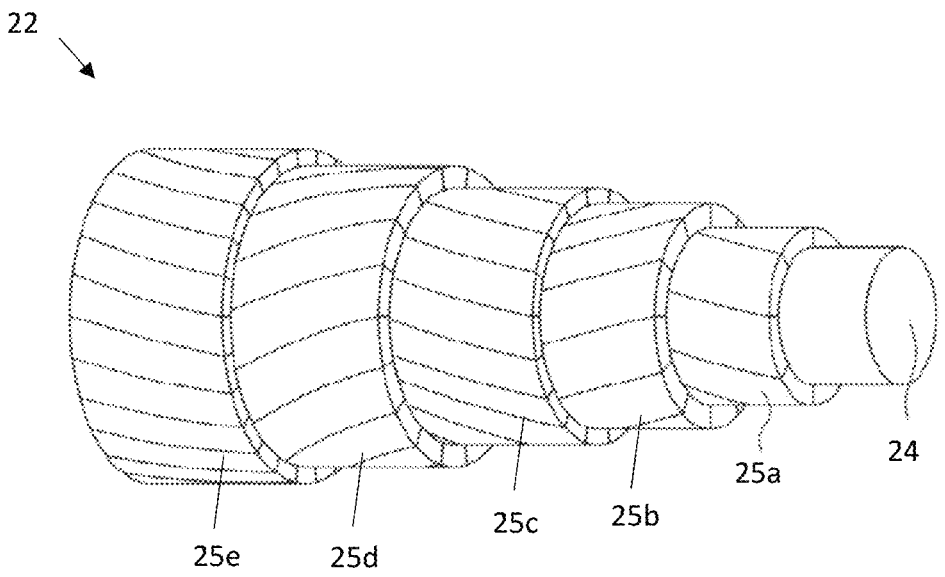
Fig. 1: Prior art
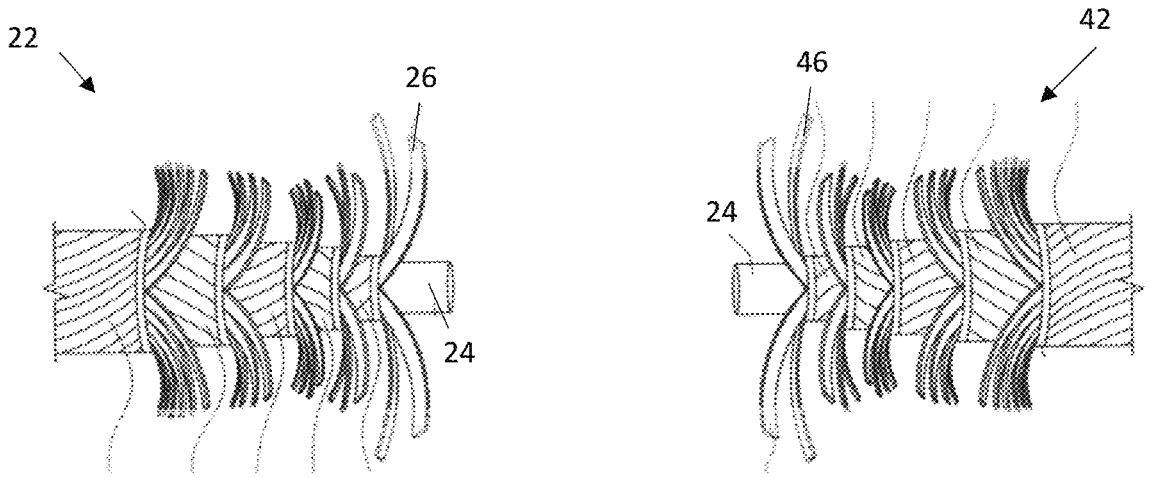
Fig. 2: Prior art

METHOD FOR CREATING A TRANSITION JOINT BETWEEN TWO CABLES USING CANTED COIL SPRINGS AND A CABLE ASSEMBLY HAVING SUCH A TRANSITION JOINT

RELATED APPLICATION

This Application claims the benefit of priority from European Patent Application No. 20 305 422.6, filed on Apr. 30, 2020, the entirety of which is incorporated by reference.

FIELD OF THE INVENTION

The present invention relates to a method for creating a transition joint between two cables. The present invention also relates to a cable assembly.

BACKGROUND OF THE INVENTION

Electric power cables must often be joined. One example of the conductor of such a prior art cable is shown in FIG. 1. The conductor is typically made from copper or aluminum and consists of a circular center wire surrounded by concentric layers of stranded, typically keystone-shaped wires, resulting in a very compact conductor with a smooth surface. The strands are wound in a spiral, with the layers being wound in alternating directions, e.g. the first layer is wound in a clockwise spiral, the next layer wound in a counter clockwise spiral and so on. The configuration of central wire/stranded wires provides the cable with improved flexibility. The above conductor is surrounded by a plurality of insulating/protective layers (not shown in FIG. 1).

Sections of the above power cables must in some situations be joined together to form one single power cable.

In US 2018/0375223 (Nexans), one method is disclosed. Here, the stranded wires of each cable end are unwound and pulled back to expose the ends of each layer and the central rod, then a connection piece is thermally joined between the ends of the central rod of each cable. Then the stranded wires of each layer of the two cables are rewound and thermally joined to each other outside each other. In a final step, insulating/protective layers are added outside of the joining area of the two cables. In FIG. 2, it is shown how the stranded wires of each cable end are unwound and pulled back. This method is very time-consuming.

The object of the present invention is to provide a more time-efficient method of creating a transition joint between two cables. Another object of the present invention is to provide a method of creating a flexible transition joint between two cables. Another object of the present invention is to provide a method of creating a transition joint between two different cables.

SUMMARY OF THE INVENTION

The present invention relates to a cable assembly comprising a first cable having a first conductor, a second cable having a second conductor and an electrically conducting joining element;

characterized in that the joining element comprises a first opening and a second opening;

the cable assembly comprises a number of canted coil springs;

a terminal portion of the first conductor is secured to the first opening by means of a first canted coil spring;

a terminal portion of the second conductor is secured to the second opening by means of a second canted coiled spring.

In one aspect, the cable assembly comprises at least two canted coil springs for securing the first conductor to the first opening and/or at least two canted coil springs for securing the second conductor to the second opening.

In one aspect, the first opening is located in a first end of the joining element and the second opening is located in a second end of the joining element.

In one aspect, the electrically conducting joining element is a part of the conductor of the cable assembly.

In one aspect, the canted coil springs are oriented circumferentially around a central longitudinal axis of the first and second conductors.

In one aspect, the canted coil springs are provided in annular compartments, each compartment formed by:

a groove provided in the first conductor and a groove provided in the first opening; or a groove provided in the second conductor and a groove provided in the second opening.

In one aspect, the groove is an indentation with respect to the surface of each side of the groove. Hence, the grooves in the openings represent an increase in diameter with respect to the surface on each side of the groove, while the grooves in the first and second conductors represent a decrease in diameter with respect to the surface on each side of the groove.

In one aspect, the groove provided in the first conductor is axially aligned with the groove provided in the first opening and wherein the groove provided in the second conductor is axially aligned with the groove provided in the second opening.

In one aspect, each canted coil spring has an inner diameter substantially equal to the diameter of the outer circumferential groove of the conductor and an outer diameter substantially equal to the diameter of the grooves of the joining element.

In one aspect, the first and second conductors each comprises a central wire surrounded by a plurality of layers of stranded wires wound about the central wire, wherein the central wire and the plurality of layers are cut back to expose their outer circumferential surface, wherein the groove is an outer circumferential groove provided in one or several of the cut back and exposed outer circumferential surfaces.

In one aspect, the central wire and plurality of layers are cutting back to expose an axial length of 1-4 cm of its outer circumferential surface.

In one aspect, the step of cutting back and exposing is creating a stair-like profile of the conductors of the first and second cables.

In one aspect, the cut-back and exposed central wire and/or some of the layers of the first and second conductors comprises a conical profile.

In one aspect, the openings comprises a funnel-shaped profile.

In one aspect, the canted coiled springs are guided into their compartments by means of the funnel-shaped profile and/or the conical profile during assembly operation of the cable assembly.

In one aspect, the first opening has a shape adapted to receive the first conductor and wherein the second opening has a shape adapted to receive the second conductor.

In one aspect, the first opening has a shape corresponding to the cut back and exposed first conductor; and wherein the second opening has a shape corresponding to the cut back and exposed second conductor.

In one aspect, the first conductor is different from the second conductor.

In one aspect, the diameter of the conductor of the first cable may be different from the diameter of the conductor of the second cable. In one aspect, the number of layers of stranded wires of the conductors may be different. However, as the first opening of the joining element is adapted to receive the terminal portion of the first cable and the second opening of the joining element is adapted to receive the terminal portion of the second cable, the two cables may still be connected in the same way as two identical cables.

In one aspect, there are no grooves provided in the outermost layer of stranded wires. In this way, it may be easier to obtain a constant diameter for the conductor of the cable assembly.

In one aspect, the joining element is manufactured by a machining process, a casting process or a 3D-printing process.

In one aspect, the joining element is made of the same material as the conductors of the first and second cables. In one aspect, the joining element is made of a copper or aluminium material.

In one aspect, the canted coil springs are made of an electrically conducting material.

The present invention also relates to a a method for joining a first cable having a first conductor and a second cable having a second conductor; comprising the steps of:

providing an electrically conducting joining element comprising a first opening and a second opening;

providing a number of canted coil springs;

securing the first conductor to the first opening by means of a first canted coil spring;

securing the second conductor to the second opening by means of a second canted coiled spring.

In one aspect, the method further comprises the steps of:

providing a groove in the first conductor and a groove in the first opening, the grooves together forming an annular compartment for one of the canted coiled spring;

providing a groove in the second conductor and a groove in the second opening, the grooves together forming an annular compartment for another canted coiled spring.

In one aspect, the steps of securing comprises:

providing one of the canted coil spring in the groove of the first conductor or in the groove of the first opening;

providing the other one of the canted coil spring in the groove of the second conductor or in the groove of the second opening;

inserting the first conductor into the first opening;

inserting the second conductor into the second opening;

thereby causing a temporary compression of the canted coiled springs until the canted coiled springs are allowed to expand when the grooves in the joining element become aligned with the grooves of the respective conductors.

The present invention also relates to a cable assembly comprising a first cable having a first conductor and a second cable having a second conductor;

characterized in that:

a terminal portion of the first conductor has been cut back to expose its outer circumferential surface, a terminal portion of the second conductor comprises an opening;

the cable assembly comprises a canted coil spring;

the first conductor is secured to the opening of the second conductor by means of the canted coil spring.

In one aspect, the canted coil spring is provided in an annular compartment formed by:

a groove provided in the first conductor and a groove provided in the opening of the second conductor.

In one aspect, the groove provided in the first conductor is axially aligned with the groove provided in the opening.

In one aspect, the first conductor comprises a central wire surrounded by a plurality of layers of stranded wires wound about the central wire, wherein the central wire and the plurality of layers are cut back to expose their outer circumferential surface, wherein the groove is an outer circumferential groove provided in one or several of the cut back and exposed outer circumferential surfaces.

In one aspect, the opening has a shape adapted to receive the terminal portion of the first conductor.

The above methods are used to join two high voltage, stranded cables at a flexible transition joint. In the context of the invention, the term "flexible" means that the transition joint has essentially the same or equal handling capabilities as non-spliced sections of the cable itself under intended use scenarios for the cable. For example, a section of cable comprising a "flexible" transition joint according to the invention may be transported, installed or handled in the same manner as non-spliced sections of the cable without the need for additional or different equipment or handling procedures.

The term "central wire" or "centre wire" refers to the innermost wire of the conductor. The central wire may be referred to as a centre rod.

The term "stranded wires" refers to the relatively thinner (compared to the central wire) wires wrapped about the central wire. In one embodiment, the stranded wires have a keystone shaped cross section. Alternatively, the stranded wires may be round wires or compressed round wires.

The stranded wires are wrapped about the central wire in a spiral in layers comprising an integer number of strands per layer. The term "first layer" refers to the innermost layer of strands. The next innermost layer is referred to as the "second layer" and so forth. The outermost layer may be alternatively referred to by its ordinal position, or merely by the term "outer layer" or "outermost layer" of strands. The strands of different layers of the same cable may have different thicknesses, and the corresponding layers of the two cables may or may not contain an equal number of strands. The strands of a given layer travel together in tandem, adjacent to one another, in a spiral about the central wire. The layers alternate in the direction of the spiral.

BRIEF DESCRIPTION OF THE DRAWINGS

Embodiments of the invention will now be described in detail with reference to the enclosed drawings, where:

FIG. 1 illustrates an end of a prior art power cable;

FIG. 2 illustrates the unwinding step of a prior art method of joining two cables;

DETAILED DESCRIPTION

Embodiment 1

Figure 3:
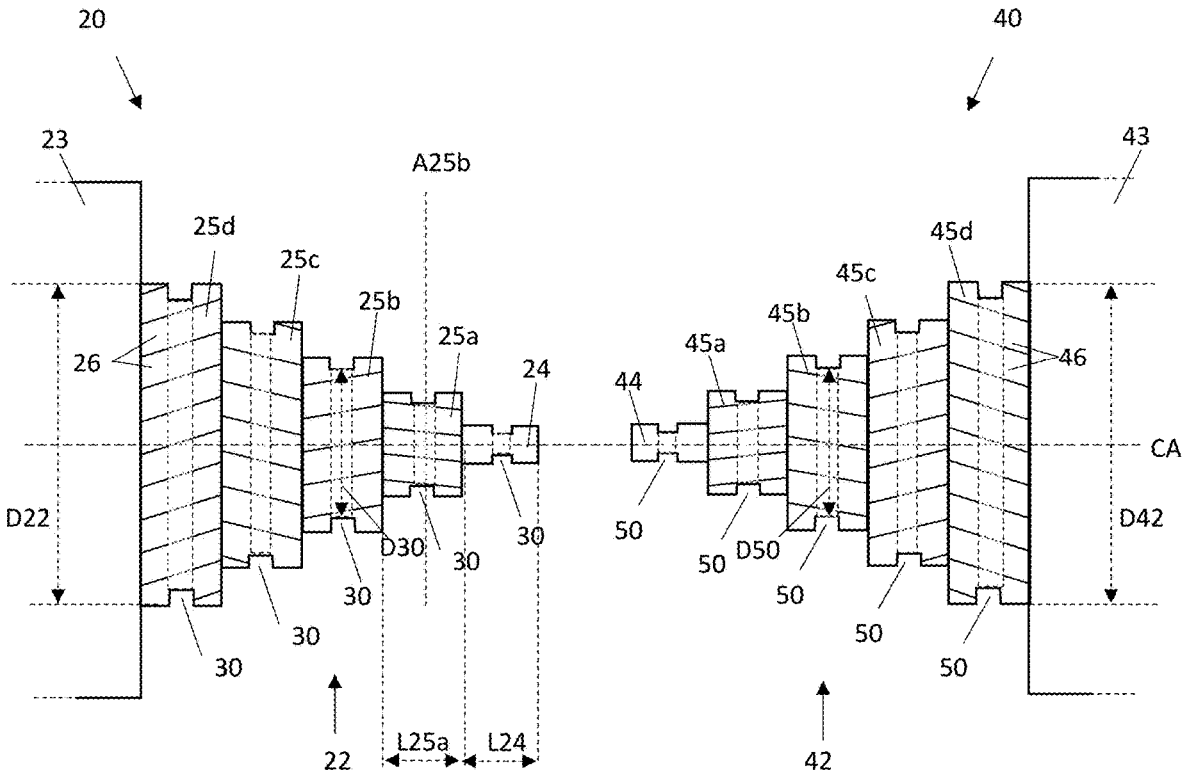
FIG. 3 illustrates two cable ends during a first step of the method.

It is now referred to FIG. 3. Here it is shown a terminal portion of a first cable 20 and a terminal portion of a second cable 40. As shown, each of the cables 20, 40 are of the prior art type shown in FIGS. 1 and 2.

The first cable 20 comprises a first conductor 22 and insulating and/or protective layers 23 provided radially outside of the first conductor 22. The first conductor 22 comprises a central rod or wire 24 surrounded by a plurality of layers 25*a-d*, each layer comprising a number of stranded wires 26 wound about the central wire 24. The stranded wires 26 are wrapped about the central wire in a spiral in layers comprising an integer number of strands per layer. The strands of a given layer travel together in tandem, adjacent to one another, in a spiral about the central wire. The layers alternate in the direction of the spiral. The diameter D22 of the first conductor 22 is indicated in FIG. 3.

Similarly, the second cable 40 comprises a second conductor 42 and insulating and/or protective layers 43 provided radially outside of the second conductor 42. The second conductor 42 comprises a central rod or wire 44 surrounded by a plurality of layers 45*a-d*, each layer comprising a number of stranded wires 26 wound about the central wire 24. The diameter D42 of the conductor 42 is indicated in FIG. 3.

Hence, in the present embodiment, each cable 20, 40 comprises four layers of stranded wires outside of the central wire 24, 44. A central axis CA is also indicated in FIG. 3. The conductors 22, 42 are typically made of copper or aluminum. The diameter D22 of the first conductor 22 is here equal to the diameter D42 of the second conductor D42.

As shown in FIG. 3, the insulation and/or protective layer 23, 43 has been removed from the terminal portion of each cable 20, 40. Moreover, each layer has been cut back and a section of the central wire and the layers of stranded wires are exposed. In FIG. 3, an exposed length L24 for the central wire 24 and an exposed length L25*a* for the first layer 25*a* of stranded wires have been indicated. This exposed length will typically be 1-4 cm, preferably ca 2 cm, but longer exposed lengths are also possible. It should be noted that even though not indicated in FIG. 3, a corresponding exposed length is present for the central wire and all layers of stranded wires for both the first cable and the second cable.

It is further shown in FIG. 3 that a groove 30 has been provided circumferentially in, i.e. in the outwardly facing or radial surface of, the central wire 24 and in the respective layers 25*a-d*.

Similarly, a groove 50 has been provided circumferentially in, i.e. in the outwardly facing or radial surface of, the central wire 44 and in the respective layers 45*a-d* of the second cable 40. This may be performed by means of a milling process etc.

Figure 4:
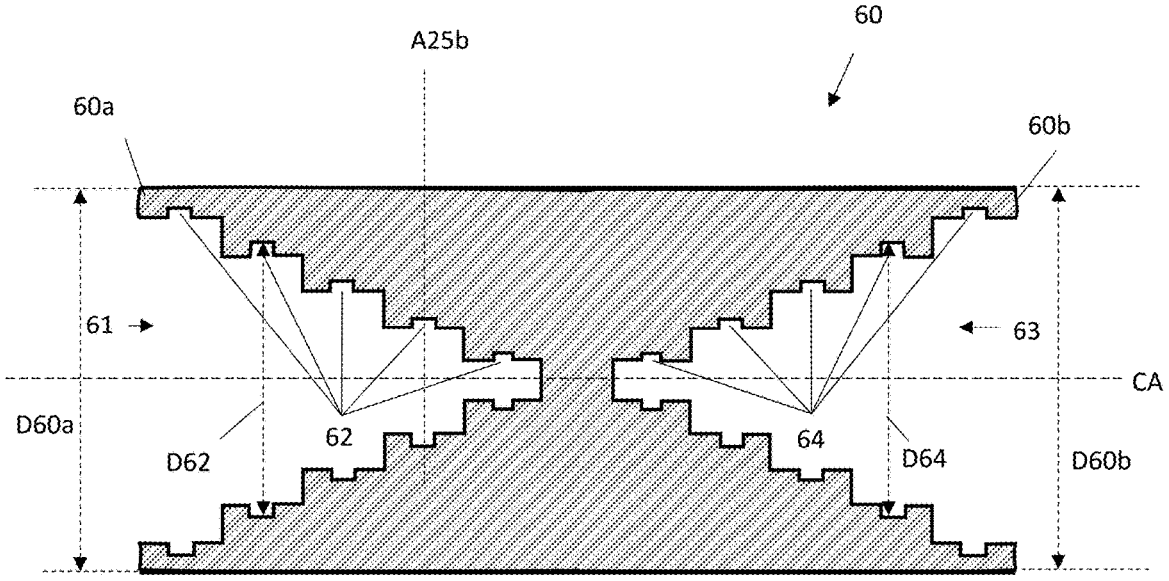
FIG. 4 illustrates a joining element.

It is now referred to FIG. 4, where an electrically conducting joining element 60 is shown. In this embodiment, the joining element 60 is substantially cylindrical with a first opening 61 provided in a first end 60*a* and a second opening 63 provided in a second end 60*b*. The first opening 61 is adapted to receive the terminal portion of the first cable 20, more specifically the cut back and exposed conductor 22 shown in FIG. 3. Similarly, the second opening 63 is adapted to receive the cut back and exposed conductor 42 shown in FIG. 3.

A joining process of two cables have two purposes. First, the joined cable, comprising the first cable 20, the second cable 40 and the joint itself, must allow electrical current to flow between the first and second conductors 22, 42. Second, the joined cable, comprising the first cable 20, the second cable 40 and the joint itself, must satisfy mechanical requirements. Some of the mechanical requirements may be fulfilled by mechanical properties of the insulating and/or protective layers 23, 43 surrounding the conductors and the joint of these insulating protective layers, which are outside of the scope of the present invention. However, some mechanical requirements must also be fulfilled by means of mechanical properties of the joint of the conductors.

Hence, for both electrical purposes and for mechanical purposes, the first opening 61 is shaped to the cut back and exposed terminal portion of the first cable and the second opening 63 is adapted to the cut back and exposed terminal portion of the second cable. Hence, the contact area between the first conductor 22 and the joining element 60, and between the second conductor 42 and the element 60, should be as large as possible.

The joining element 60 is machined, casted or 3D-printed. Preferably, the joining element 60 is made of the same material as the conductors of the first and second cables, such as copper or aluminum. The joining element 60 may be provided as one single body, or may comprise a number of parts assembled to form the joining element of FIG. 60.

In FIG. 4, it is further shown that grooves 62 are provided as part of the first opening 61 of the joining element 60 and that grooves 64 are provided as part of the second opening 63 of the joining element 60. As indicated by the dashed line A25*b* in FIGS. 3, 4 and 8, the grooves 62 of the joining element 60 are axially aligned with the grooves 30 of the first conductor 22 when the terminal portion of the first cable 20 has been inserted into the first opening 61.

Similarly, the grooves 64 of the joining element 60 are axially aligned with the grooves 50 of the second conductor 42 when the terminal portion of the second cable 40 has been inserted into the second opening 63.

Each of the grooves 30, 50, 62, 64 of the present embodiment have a substantially rectangular or U-shaped cross-sectional shape. Alternatively, the grooves may be semicircular. Hence, when assembled and aligned with the respective corresponding one of the grooves, the grooves 30, 62 together form a number of annular compartments and the grooves 50, 64 together form a number of annular compartments.

Figure 5:
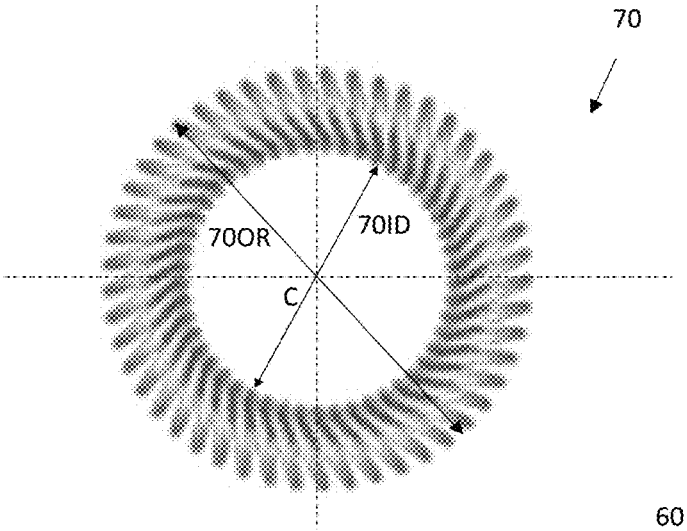
FIG. 5 illustrates a canted coiled spring.

It is now referred to FIG. 5, which show a canted coiled spring 70. Such canted coiled springs is commercially available, for example from the company BAL SEAL ENGINEERING, sold under the name BAL SPRING®. Hence, the canted coiled spring is considered known for a person skilled in the art and will not be described further in detail herein. The canted coiled spring 70 has its inner diameter 70ID, its outer diameter 70OD and its center C indicated in FIG. 5.

The canted coil spring 70 may also be manufactured by an electrically conducting material.

Figure 6:
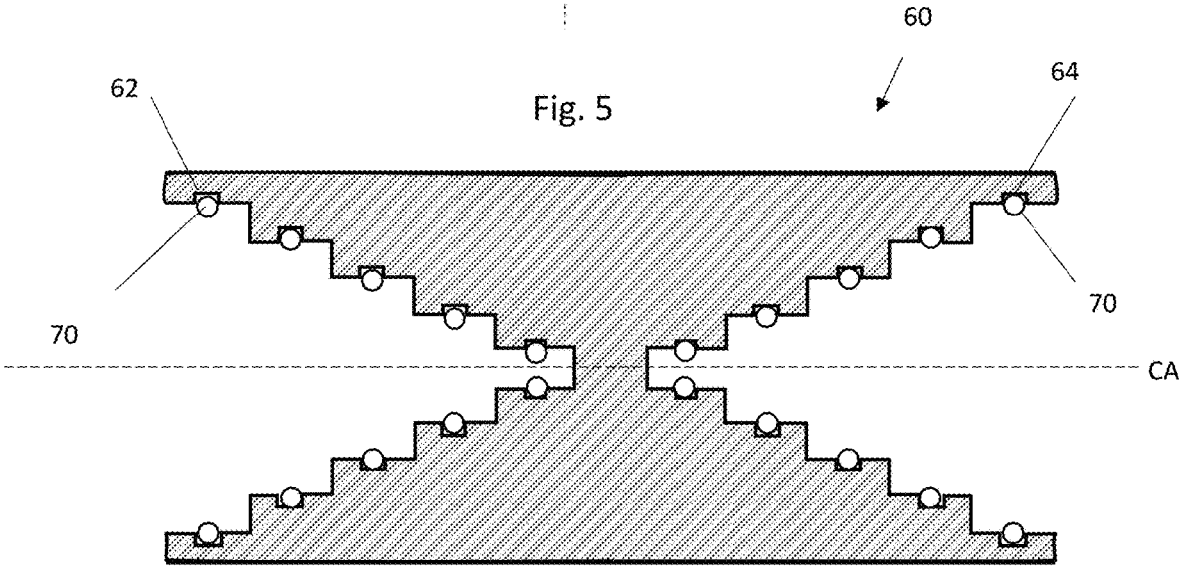
FIG. 6 illustrates canted coiled springs provided in the grooves of the joining element.

It is now referred to FIG. 6. Here, one canted coil spring 70 is provided in each groove 62, and one canted coil spring 70 is provided in each groove 64. The center C of each canted coiled spring 70 is coinciding with the central axis of the joining element 60. The outer diameter 70OD of the canted coiled spring 70 is equal to, or substantially equal to, the diameter D62, D64 of the respective grooves 62, 64 of the joining element 60.

The terminal portion of the first cable 20 from FIG. 3 is now inserted into the first opening 61 of FIG. 6 and the terminal portion of the second cable 40 from FIG. 3 is now inserted into the second opening 63. This will cause a temporary compression of the canted coiled springs 70 until the canted coiled springs 70 are allowed to expand when the grooves 62, 64 in the joining element 60 become aligned with the grooves 30, 50 of the respective terminal portions of the cables 20, 40.

Figure 8:
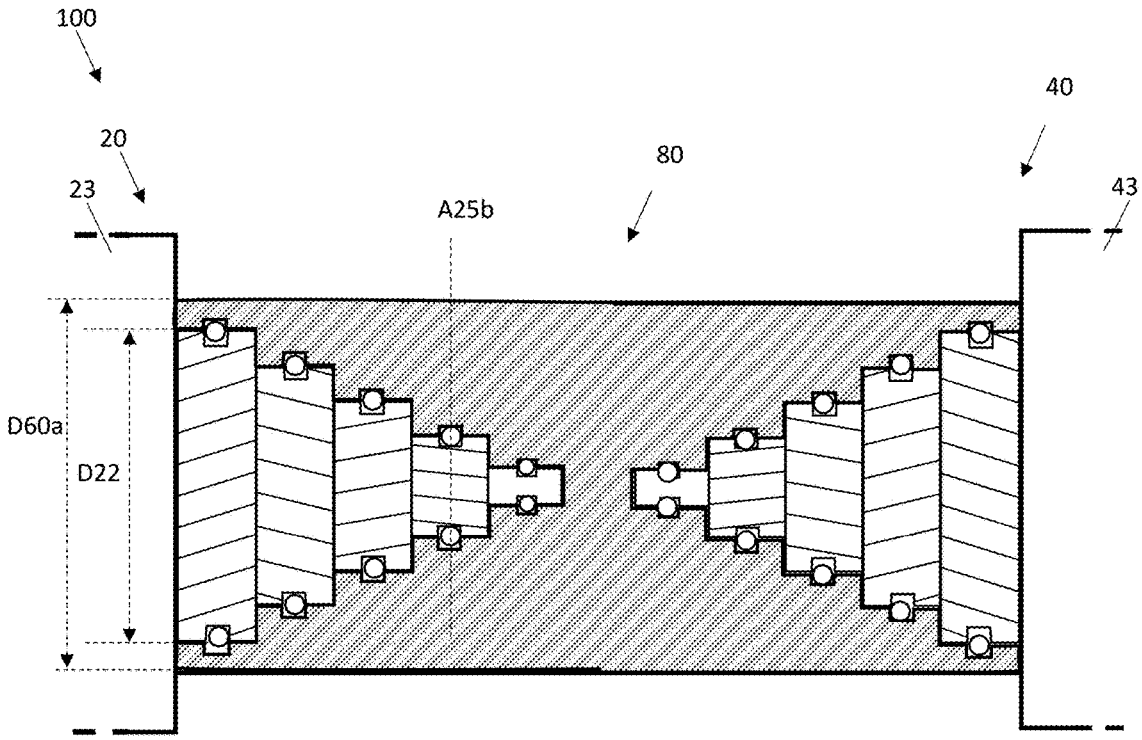
FIG. 8 illustrates the joint of the two cables.

In FIG. 8, the result is shown, and the joint is indicated as reference number 80. Due to the properties of such canted coiled springs 70, the terminal portion of the first cable 20 is now mechanically locked to the opening 61 of the joining element 60 and the terminal portion of the second cable 40 is now mechanically locked to the opening 63 of the joining element 60, as a considerable force is needed to pull them apart from each other again.

As a final step, the insulation/protective layers 23, 43 are joined radially outside of the joining element 60. This is an operation that is performed in similar way as in prior art, and hence this operation will not be described herein in detail.

The result is a cable assembly 100 comprising the first and second cables 20, 40, the joining element 60 and the canted coiled springs 70.

Embodiment 2

An alternative embodiment will now be described with reference to FIGS. 4 and 7. It should be noted that only differences with respect to the first embodiment will be described.

Figure 7:
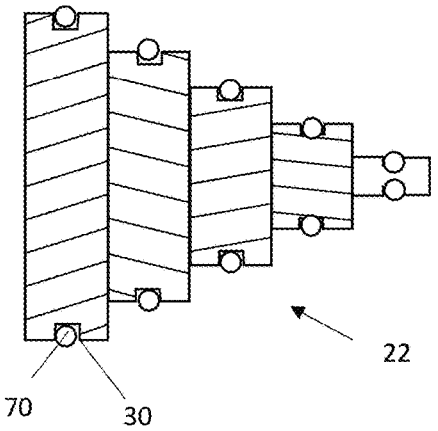
FIG. 7 illustrates canted coiled springs provided in the grooves of a cable end.

Here, the canted coiled springs 70 are provided in the grooves 30 of the first conductor 22 as shown in FIG. 7. Similarly, canted coiled springs 70 are provided in the grooves 50 of the conductor 42 (not shown). As above, each canted coil spring 70 has an inner diameter 70ID substantially equal to the diameter D30, D50 of the respective outer circumferential groove 30, 50 of the conductor 22, 42 and an outer diameter 70OD substantially equal to the diameter D62, D64 of the respective grooves 62, 64 of the joining element 60.

Then, the conductors 22, 42 are inserted into the joining element 60 of FIG. 4 (i.e. having no canted coiled springs within its grooves 62, 64). This will also result in a joint as shown in FIG. 8.

Embodiment 3

In FIG. 8 described above, it is shown that the outer diameter D60*a* of the first end 60*a* of the joining element 60 is larger than the outer diameter of the first conductor 22.

Figure 9:
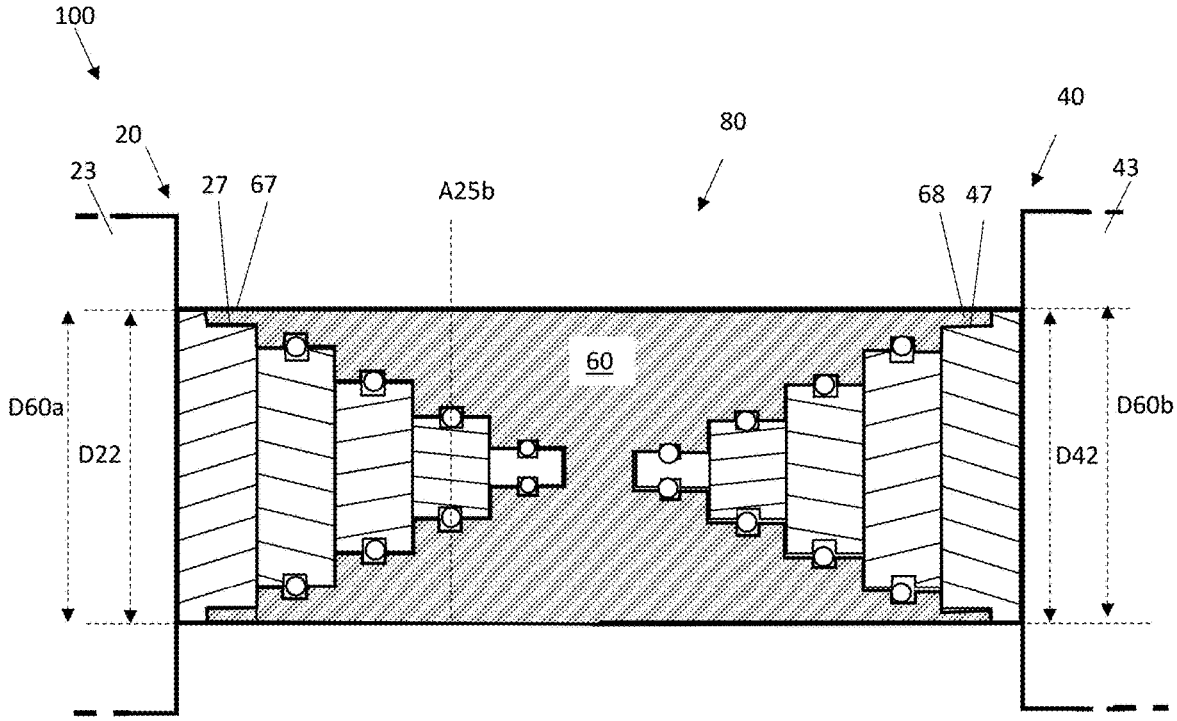
FIG. 9 illustrates an alternative joint of the two cables.

However, in many applications, it is desired to have the same diameter in a joint as in the cable conductors 22, 42. It is now referred to FIG. 9. Here, there are no canted coiled springs 70 (and no grooves) in the outer layer 25*d*, 45*d* of stranded wires. However, the outer layer comprises a step 27, 47 as shown in FIG. 9, where the joining element 60 comprises a lip 67, 68 in each end inserted onto the step 27, 47. Hence, as shown in FIG. 9, the outer diameter D22 of the conductor 22 is equal to the outer diameter D60*a* of the joining element 60. As above, this embodiment shows how two identical cables 20, 40 are joined, therefore, the outer diameter D42 of the second conductor 42 and the outer diameter D60*b* of the second end 60*b* of the joining element 60 is equal to the outer diameter D22 of the first conductor 22.

Embodiment 4

Figure 10:
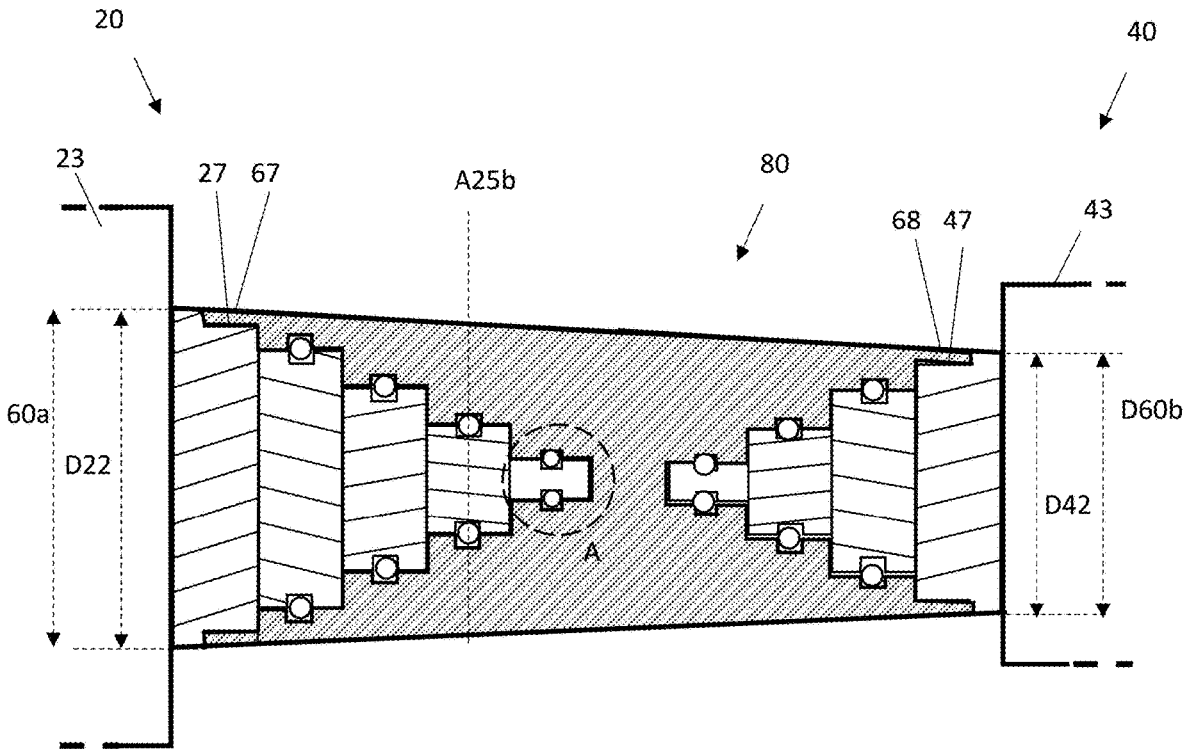
FIG. 10 illustrates a joint of two cables of different type.

It is now referred to FIG. 10. The first cable 20 is here identical to the first cable 20 of the previous embodiments. The second cable 40 is similar to the second cable 40 described above. However, the second cable 40 here has only three layers of stranded wires outside of the central wire. Hence, the outer diameter D42 of the second conductor 42 is smaller than the outer diameter D22 of the first conductor. Here, the opening 63 of the joining element 60 is also adapted to the second conductor 42, thereby causing the outer diameter D60*b* of the second end 60*b* of the joining element to be equal to the outer diameter D42 of the second conductor 42 and hence also smaller than the outer diameter of the first end D60*a*. Consequently, the outer or radial surface of the joining element 60 will have the shape of a truncated cone.

Embodiment 5

Figure 11:
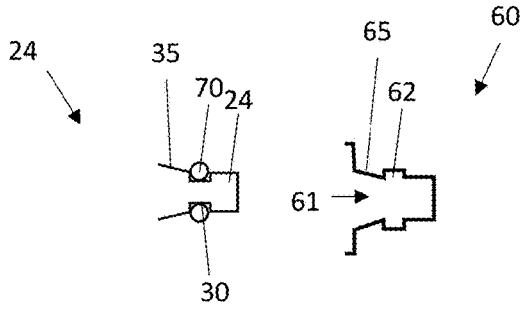
FIG. 11 illustrates an alternative embodiment of the details within circle A of FIG. 10.

It is now referred to FIG. 11, showing an alternative shape of the cut back and exposed central wire 24 of the first conductor 24 and the corresponding shape of the joining element 60. Here, the opening 61 comprises a funnel-shaped profile 65 for guiding and compressing the canted coiled spring 70 during its movement towards the groove 62. A corresponding conical profile 35 may be provided on the central wire 24.

It should be noted that the first opening 61 may comprise one such funnel-shaped profile for each groove 62 and that the second opening 63 may also comprise such funnel-shaped profiles. Hence, also each layer of stranded wires may comprise a corresponding conical profile for each groove 30 and the second conductor may comprise such conical profiles.

Embodiment 6

Figure 12:
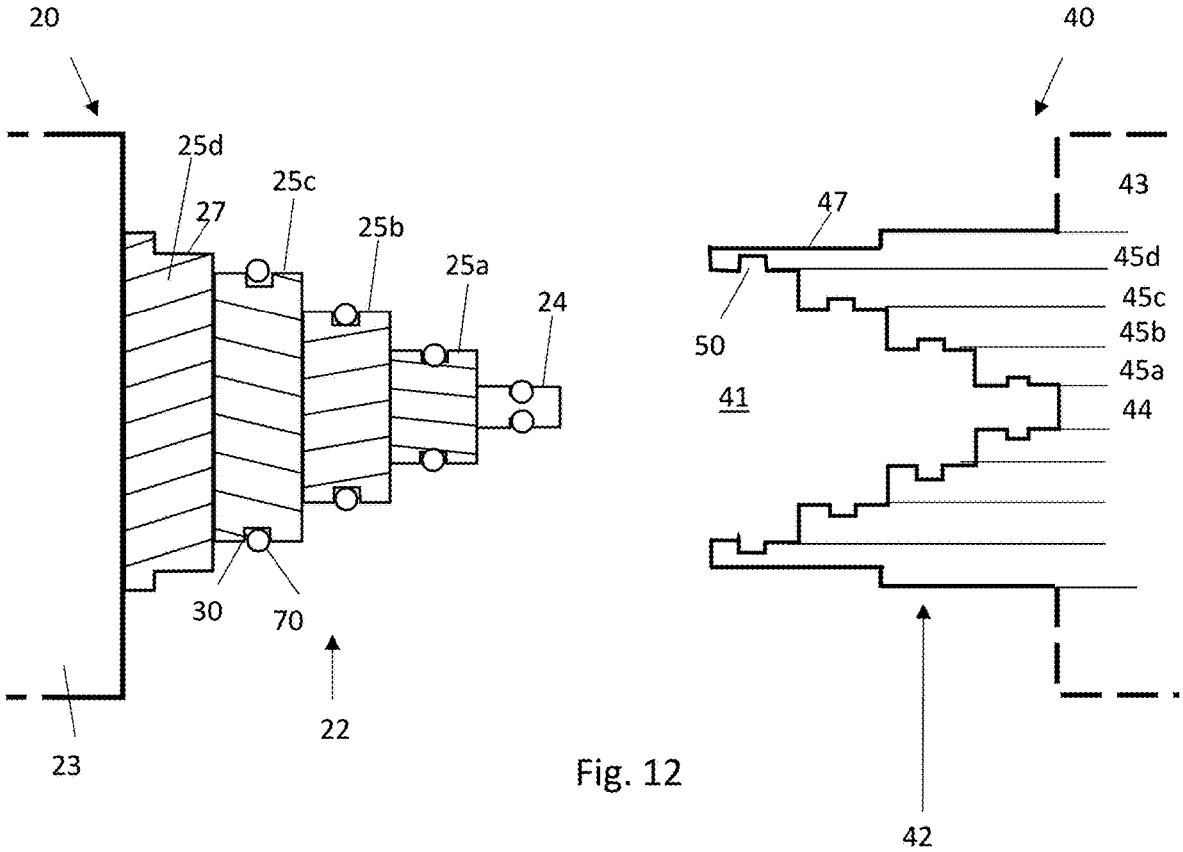
FIG. 12 illustrates respective terminal ends of two cable conductors before they are being joined.
Figure 13:
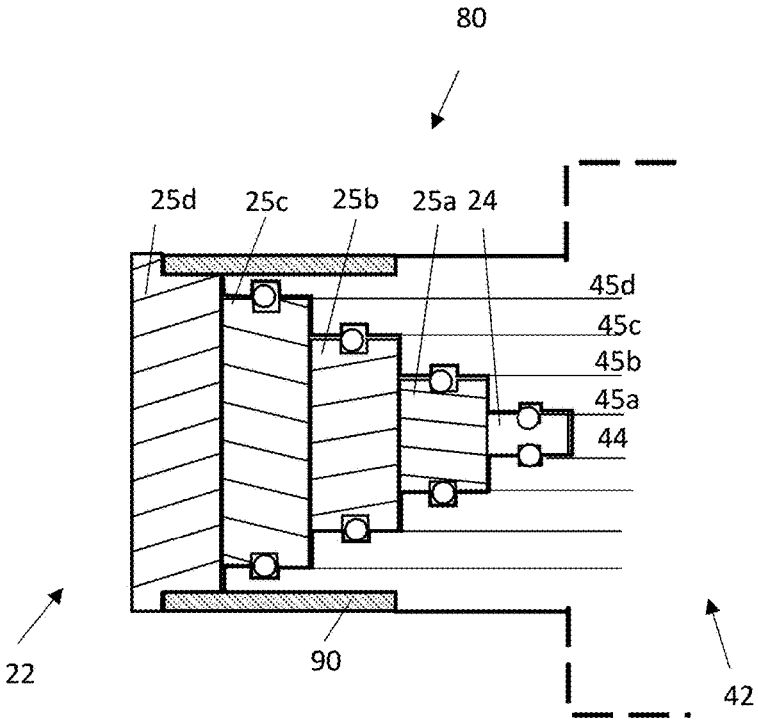
FIG. 13 illustrates the terminal ends of the two cable conductors after they have been joined.

It is now referred to FIGS. 12 and 13. The first cable 20 and the second cable 40 are here identical to the cables 20, 40 of the first embodiment above.

Similar to the first embodiment, the central wire 24 and each layer 25*a-d* of stranded wires 26 of the terminal portion of the first cable 20 are cut back and exposed. Similar to the first embodiment, outer circumferential grooves 30 are provided in the central wire 24 and the layers 25*a-c* of stranded wires 26 of the first cable 20. As in the third and fourth embodiments above, there is no groove 30 in the outer layer 25*d*, here only a step profile 27 is provided.

In the present embodiment, instead of using a joining element 60, an opening 41 is cut into the second conductor 42 of the second cable 40. Also here, the central wire 44 and each layer 45*a-d* of stranded wires 46 will be exposed. However, as shown in FIG. 12, only the end surface of the central wire 44 is exposed. In addition, the radially inwardly facing surfaces together with the end surfaces of the layers 45*a-d* are exposed. A step 47 is also provided on the radial outer surface of the outermost layer 45*d*, similar to the first embodiment above. The opening 41 in the second conductor 42 will be adapted to receive the conductor portion 22 of the first cable 20.

Grooves 50 is now provided in the conductor 44 of the second cable 40 axially aligned with the grooves 30 of the first cable 20 when the respective terminal portion of the first cable has been inserted into the opening 41 of the second cable 40.

Similar to the above embodiments, canted coil springs 70 are provided in the grooves 30 of the first cable 20 or in the grooves 50 of the second cable 40. The first conductor 22 of the first cable 20 is now inserted into the opening 41 of the conductor 42 of the second cable 40, causing a temporary compression of the canted coiled springs 70 until the canted coiled springs 70 are allowed to expand when the grooves 30 of the first cable 20 become aligned with the grooves 50 of the second cable 40.

It should be noted that the second wire 44 of the second conductor 42 and the outermost layer 25*d* of the first conductor 22 do not have any groove. The central wire 24 of the first conductor 24 has a groove and is mechanically connected to the first layer 45*a* of the second conductor 42 via one of the springs. Then, the first layer 25*a* of the first conductor 22 is connected to the second layer 45*b* of the second conductor 42 via one of the springs. Then, the second layer 25*b* of the first conductor 22 is connected to the third layer 45*c* of the second conductor 42 via one of the springs. Then, the third layer 25*c* of the first conductor 22 is connected to the fourth layer 45*d* of the second conductor 42 via one of the springs.

The steps 27, 47 are radially aligned with each other. As shown in FIG. 13, a sleeve 90 is circumferentially surrounding the steps 27, 47. The outer diameter of the sleeve is equal to the outer diameter of the outermost layers 25*d*, 45*d*, and hence, there is no radial expansion in the area of the joint 80.

ALTERNATIVE EMBODIMENTS

In FIG. 3 above, the central wire and each layer of stranded wires were cut back and exposed. It should be noted that it is also possible to not cut back and expose every layer, for example only to cut back and expose every second layer etc.

The invention claimed is:

1. A cable assembly comprising:
- a first cable having a first conductor,
- a second cable having a second conductor and
- an electrically conducting joining element;
- the joining element comprising a first opening and a second opening;
- the cable assembly comprising a number of canted coil springs;
- a terminal portion of the first conductor being secured to the first opening by means of a first canted coil spring;
- a terminal portion of the second conductor being secured to the second opening by means of a second canted coiled spring wherein the canted coil springs are provided in annular compartments:
- each compartment being formed by a groove provided in the first conductor and/or a groove provided in the first opening; and/or
- each compartment being formed by a groove provided in the second conductor and/or a groove provided in the second opening.

2. The cable assembly according to claim 1, wherein the canted coil springs are oriented circumferentially around a central longitudinal axis of the first and second conductors.

3. The cable assembly according to claim 1, wherein the canted coil springs are electrically connecting the respective terminal portions of the first conductor and of the second conductor with the electrically conducting joining element.

4. The cable assembly according to claim 3, wherein the groove provided in the first conductor is axially aligned with a groove provided in the first opening and wherein the groove provided in the second conductor is axially aligned with a groove provided in the second opening.

5. The cable assembly according to claim 1, each canted coil spring has an inner diameter substantially equal to the diameter of the outer circumferential groove of the conductor and an outer diameter substantially equal to the diameter of grooves of the joining element.

6. The cable assembly according to claim 1, wherein the first and second conductors each comprises a central wire surrounded by a plurality of layers of stranded wires wound about the central wire, wherein the central wire and the plurality of layers are respectively cut back to expose their respective outer circumferential surface, wherein the groove is an outer circumferential groove provided in one or several of the cut back and exposed outer circumferential surfaces.

7. The cable assembly according to claim 6, wherein the cut-back and exposed central wire and/or some of the layers of the first and second conductors comprises a conical profile, wherein at least two of the central wire and the plurality of layers are cut back such that two distinct grooves are provided in two distinct exposed outer circumferential surfaces, respective outer circumferential surfaces having distinct diameters for their respective outer circumferential groove, and two distinct canted coil springs are provided respectively in each outer circumferential groove.

8. The cable assembly according to claim 6, wherein the openings comprises a funnel-shaped profile.

9. The cable assembly according to claim 1, wherein the first opening has a shape adapted to receive the first conductor and wherein the second opening has a shape adapted to receive the second conductor.

10. The cable assembly according to claim 1, wherein the first conductor is different from the second conductor.

11. The cable assembly according to claim 1, wherein the canted coil springs are provided in annular compartments, each compartment being formed by:
- a groove provided in the first conductor and a groove provided in the first opening; and
- a groove provided in the second conductor and a groove provided in the second opening.

12. A method for joining a first cable having a first conductor and a second cable having a second conductor; said method comprising the steps of:
- providing an electrically conducting joining element comprising a first opening and a second opening;
- providing a number of canted coil springs in annular compartments, each compartment being formed by a groove provided in the first conductor; and/or a groove provided in the second conductor;
- securing the first conductor to the first opening by means of a first canted coil spring;
- securing the second conductor to the second opening by means of a second canted coiled spring.

13. The method according to claim 12, wherein the method further comprises the steps of:
- providing a groove in the first conductor and a groove in the first opening, the grooves together forming an annular compartment for one of the canted coiled spring;
- providing a groove in the second conductor and a groove in the second opening, the grooves together forming an annular compartment for another canted coiled spring.

14. The method according to claim 13, wherein the steps of securing comprises:

providing one of the canted coil spring in the groove of the first conductor or in the groove of the first opening;

providing the other one of the canted coil spring in the groove of the second conductor or in the groove of the second opening;

inserting the first conductor into the first opening;

inserting the second conductor into the second opening;

thereby causing a temporary compression of the canted coiled springs until the canted coiled springs are allowed to expand when the grooves in the joining element become aligned with the grooves of the respective conductors.

15. The method according to claim 13, wherein the steps of providing grooves comprises the steps of:

machining, casting and or 3D-printing the joining element.

16. The method according to claim 13, wherein the step of providing a canted coil spring comprises:

providing the canted coil spring of an electrically conducting material.

17. The method according to claim 13, wherein the step of providing a canted coil spring comprises:

providing the canted coil spring having an inner diameter substantially equal to the diameter of the outer circumferential groove of the conductor and an outer diameter substantially equal to the diameter of the grooves of the joining element.

18. The method according to claim 12, wherein, after providing two cables; the method further comprises the steps of:

a) removing, from terminal portions of the cables, any insulating and/or protective layers surrounding the conductors;

b) cutting back and exposing, from terminal portions of the cables, the central wire and each layer of stranded wires;

c) providing an outer circumferential groove in the central wire and at least some of the layers of stranded wires;

d) providing an electrically conducting joining element having a first opening adapted to receive the conductor of the first cable and a second opening adapted to receive the conductor of the second cable;

e) providing grooves in the joining element axially aligned with the grooves of the conductors of the cables when the respective conductors have been inserted into their respective opening;

f) providing a canted coil spring in the grooves of the respective conductors of the cables or in the grooves of the joining element;

g) inserting the conductor of the first cable into the first opening and inserting the conductor of the second cable into the second opening; causing a temporary compression of the canted coiled springs until the canted coiled springs are allowed to expand when the grooves in the joining element become aligned with the grooves of the respective terminal portions of the cables.

19. A cable assembly comprising a first cable having a first conductor and a second cable having a second conductor;

such that:

a terminal portion of the first conductor has been cut back to expose its outer circumferential surface, a terminal portion of the second conductor comprises an opening;

the cable assembly comprises a canted coil spring;

the first conductor is secured to the opening of the second conductor by means of the canted coil spring, wherein the canted coil spring is provided in an annular compartment formed by a groove provided in the first conductor and/or a groove provided in the opening of the second conductor.

20. The cable assembly according to claim 19, wherein the canted coil spring is provided in an annular compartment formed by:

a groove provided in the first conductor and a groove provided in the opening of the second conductor.

21. The cable assembly according to claim 19, wherein the first conductor comprises a central wire surrounded by a plurality of layers of stranded wires wound about the central wire, wherein the central wire and the plurality of layers are cut back to expose their outer circumferential surface, wherein the groove is an outer circumferential groove provided in one or several of the cut back and exposed outer circumferential surfaces, wherein at least two of the central wire and the plurality of layers of the first conductor are cut back such that two distinct grooves are provided in two distinct exposed outer circumferential surfaces, respective outer circumferential surfaces having distinct diameters for their respective outer circumferential groove, and two distinct canted coil springs are provided respectively in each outer circumferential groove.

22. The cable assembly according to claim 19, wherein the opening has a shape adapted to receive the terminal portion of the first conductor.

* * * * *